US006273943B1

(12) United States Patent
Chiba et al.

(10) Patent No.: US 6,273,943 B1
(45) Date of Patent: Aug. 14, 2001

(54) ELECTROLESS COMPOSITE PLATING SOLUTION AND ELECTROLESS COMPOSITE PLATING METHOD

(75) Inventors: Tadashi Chiba; Koji Monden, both of Hirakata (JP)

(73) Assignee: C. Uyemura & Co., Ltd., Osaka (JP)

( * ) Notice: Subject to any disclaimer, the term of this patent is extended or adjusted under 35 U.S.C. 154(b) by 0 days.

(21) Appl. No.: 09/481,608

(22) Filed: Jan. 12, 2000

(30) Foreign Application Priority Data

Jan. 12, 1999 (JP) ..... 11-004916

(51) Int. Cl.[7] ..... C23C 18/31; C23C 18/36; C23C 18/40; C23C 18/44; C23C 18/50

(52) U.S. Cl. ..... 106/1.22; 106/1.23; 106/1.24; 106/1.25; 106/1.26; 106/1.27; 106/1.28; 106/1.29; 427/443.1

(58) Field of Search ..... 106/1.22, 1.23, 106/1.24, 1.25, 1.26, 1.27, 1.28, 1.29; 427/443.1

(56) References Cited

U.S. PATENT DOCUMENTS

| | | | | |
|---|---|---|---|---|
| 4,098,654 | | 7/1978 | Helle et al. | 205/50 |
| 4,160,707 | | 7/1979 | Helle et al. | 205/109 |
| 4,222,828 | | 9/1980 | Zuurdeeg | 205/50 |
| 4,302,374 | | 11/1981 | Helle et al. | 524/168 |
| 4,997,686 | | 3/1991 | Feldstein et al. | 427/443.1 |
| 5,232,744 | * | 8/1993 | Nakamura et al. | 427/443.1 |
| 5,266,103 | * | 11/1993 | Uchida et al. | 106/1.22 |
| 6,054,172 | * | 4/2000 | Robinson et al. | 427/443.1 |
| 6,054,173 | * | 4/2000 | Robinson et al. | 427/443.1 |
| 6,126,989 | * | 10/2000 | Robinson et al. | 427/97 |

FOREIGN PATENT DOCUMENTS

| | | | | |
|---|---|---|---|---|
| 49-5832 | | 1/1974 | (JP) | C23B/5/00 |
| 49 26133 | | 3/1974 | (JP) | C23C/3/02 |
| 52-56026 | | 5/1977 | (JP) | C25D/15/00 |
| 52-56147 | | 5/1977 | (JP) | C08L/27/12 |
| 52-130434 | | 11/1977 | (JP) | C25D/15/00 |
| 54-159343 | | 12/1979 | (JP) | C25D/15/02 |
| 59-170254 | * | 9/1984 | (JP) . | |
| 5-163580 | | 6/1993 | (JP) | C23C/18/52 |
| 5-163581 | | 6/1993 | (JP) | C23C/18/52 |

OTHER PUBLICATIONS

Derwent abstract of JP59/170254, Sep. 1984.*

H. Matsuda et al., Trans. I.M.F., "Effect of Cationic Surfactant on Deposition Behaviour in Electroless Ni–P–PTFE Composite Plating", 1994, 72(2), pp. 55–57, no month available.

H. Matsuda et al., Trans. I.M.F., "Effect of Surfactants Addition on the Suspension of PTFE Particles in Electroless Plating Solutions", 1995, 73(1), pp. 16–18, no month available.

* cited by examiner

*Primary Examiner*—Helene Klemanski
(74) *Attorney, Agent, or Firm*—Sughrue, Mion, Zinn, Macpeak & Seas, PLLC

(57) ABSTRACT

An electroless composite plating solution comprising metal ions, a complexing agent for said metal ions, a hypophosphite serving as a reducing agent, a surface active agent, and a water-insoluble composite material, said surface active agent comprising a quaternary ammonium salt surface active agent which has two or more ethylene oxide groups and an alkyl group or a fluorine-substituted alkyl or alkenyl group, said quaternary ammonium salt surface active agent being cationic in nature or exhibiting substantially cationic properties under pH conditions of said plating solution.

8 Claims, No Drawings

ELECTROLESS COMPOSITE PLATING SOLUTION AND ELECTROLESS COMPOSITE PLATING METHOD

BACKGROUND OF THE INVENTION

This invention relates to an electroless composite plating solution which is capable of forming a composite plating film having a smooth surface and good uniformity and keeping its plating properties, such as a co-deposition ratio and a deposition rate, even after a long-term use, thus being very stable. More particularly, the present invention relates to an electroless composite plating solution which has wide utility in various fields including automotive sliding members, driving parts of precision instruments such as cameras and timepieces, molds, metallic masks in printing technologies, household appliances such as irons, and industrial blades and tools. The present invention also relates to an electroless composite plating method using the electroless composite plating solution.

A composite plating technique has been developed as a useful technique since about 1950 and has been used in diverse fields of industries.

In the technique, attention has been paid to surface active agents as an important component capable of imparting wettability, dispersion stability and the capability of co-deposition to composite plating solutions comprising insoluble powdery or fibrous materials having water repellence, e.g., fluorinated graphite and fluoroplastic particles such as tetrafluoroethylene (PTFE). In fact, many proposals have been made on the surface active agents since 1970.

For instance, Japanese Laid-open Patent Application No. Sho.49-26133 proposes an electroless composite plating solution wherein there are used, as an auxiliary agent, cationic surface active agents, nonionic surface active agents, or surface active agents exhibiting cationic properties at a pH of the plating solution (i.e., so-called amphoteric surface active agents).

In Japanese Laid-open Patent Application Nos. Sho.49-5832, Sho.52-56026, Sho.52-56147, Sho.52-130434 and Sho.54-159343, various surface active agents usable for composite plating solutions are disclosed. However, they are mainly used in composite electroplating solutions. The surface active agents proposed therein are fluorine-based cationic surface active agents as a main component and, if required, in combination with fluorine-based nonionic surface active agents.

In Japanese Laid-open Patent Application No. Sho.54-159343, it is indicated that fluorine-based cationic surface active agents are inferior in performance as compared with hydrocarbon-based cationic surface active agents.

Further, Japanese Laid-open Patent Application No. Sho.52-56026 describes co-deposition of polytetrafluoroethylene (PTFE) in which a reference is made to detailed combinations and concentrations of individual components (surface active agents). It is also stated that with fluorine-free particles (e.g., those particles of $MoS_2$, SiC, $SiO_2$ and the like), plating solutions comprising hydrocarbon-based surface active agents showing both cationic and nonionic properties are effective when being used singly or in combination. In this connection, it is stated that a preferred plating solution should comprise combinations of cationic surface active agents in terms of trimethylalkylammonium salts whose alkyl group has 10 to 20 carbon atoms such as cetyltrimethylammonium bromide, hexadecyltrimethylammonium bromide and the like, and wetting agents such as condensates of ethylene oxide and octyl phenol, nonyl phenol, lauryl phenol or the like which can be commercially available under the trade name of "Triton X-100".

In U.S. Pat. No. 4,997,686, a wide variety of combinations of surface active agents useful in electroless composite plating are described. More particularly, it is stated to use surface active agents mainly composed of nonionic surface active agents in combination with the other various surface active agents including anionic and cationic surface active agents.

Japanese Laid-open Patent Application Nos. Hei.5-163580 and Hei.5-163581 describe PTFE electroless composite plating solutions. In Japanese Laid-open Patent Application No. Hei.5-163580, it is described that a specific type of PTFE particle, which has been improved on the surfaces thereof by a two-stage chemical treatment, is used to provide a plating solution which does not contain any surfactant, thereby ensuring a good appearance and a long life. In Japanese Laid-open Patent Application No. Hei.5-163581, there is described an electroless composite plating solution comprising a water-soluble polyvinylpyridine derivative, which is unlikely to cause foam and has a long life.

According to H. Matsuda et al. (Trans. I. M. F., 1994, 72(2), pp. 55–57), there have been reported the results of their studies on PTFE composite electroless plating solutions comprising hydrocarbon or fluorine-based cationic surface active agents (of five types) and a hydrocarbon-based nonionic surface active agent (polyoxyethylene nonylphenyl ether) in combination. In Trans. I. M. F. 1995, 73(1), pp. 16–18, there have been reported studies on plating solutions which comprise a wider range in type and combination of surface active agents including anionic surface active agents.

In this way, the surface active agents used in composite plating solutions should favorably be cationic, nonionic and amphoteric in nature, and thus, it is known that substantially a whole range of surface active agents including those fluorine-based agents along with hydrocarbon and silicone-based agents can be used in this art.

In recent years, however, electroless Ni—P/PTFE composite plating technique has been extensively employed in the plating industry, with the result that there arises the problem that the currently employed electroless composite plating solutions cannot necessarily satisfy requirements of users.

More particularly, electroless composite plating solutions are significantly shorter in life than electroless plating solutions containing no composite material such as PTFE powder. Furthermore, the electroless composite plating solutions have many other problems that the resultant film has a satin-like or lusterless appearance, thus leading to the likelihood of the surface being roughened and the occurrence of various types of appearance defectives, that the deposition rate is slow, and that the plating solution is apt to decompose. In order to ensure an electroless composite plating solution which is utilized in various fields or applications as a general-purpose plating technique, it is essential to solve these problems.

In order to cope with the above problems, the conventional practice is to use surface active agents singly or in combination and severely control the concentrations of the formulation, or to increase the concentrations of co-existing materials (composite materials such as PTFE, SiC and the like) in the solution to a great excess so as to keep and control the plating solution against its aging. In case of electroless Ni—P plating solutions, however, it is substantially inevitable that phosphates and other inorganic salts, which are accumulated matters by aging, be increased in the solution. Thus, nickel phosphite is liable to be crystallized in the solution. In order to avoid this discrepancy, an effort has been made in which the concentration of a complexing agent is raised gradually.

At any event, the electroless composite plating solution has the problem that if the concentration of phosphates, which are accumulated matters by aging, increases, co-deposition ability and dispersion stability of the composite materials are both lowered abruptly. Thus, it has been expected to solve this problem.

Although it is important that an electroless composite plating solution has good performances concerning a co-deposition ratio, a deposition rate and microscopic or macroscopic uniformity of the resultant film, it is also essential for enhancing commercial values in industrial utilization that the plating solution have a long life and be low in cost and easy in handling, and be stable in performance along with a good appearance even after a long-term use through its life.

In this connection, however, in an electroless composite plating solution containing a hypophosphite as a reducing agent, when surface active agents are added to the solution, there arise many inconveniences caused by the addition of the surface active agents, i.e., problems that the resultant plating film has an unevenness of color tone in a striped pattern formed thereon, no plating portion appears, and an unevenness of co-deposition takes place.

When a surface active agent is reduced in amount in order to avoid the adverse influence by the addition of the surface active agent, the dispersion stability of particles dispersed for co-deposition (i.e., composite material) would lower without obtaining a satisfactory co-deposition ratio. In addition, the appearance of the resultant film is liable to become roughened, and a good appearance cannot be expected, thus leading to a problem that the commercial value of platings would lower.

On the other hand, as electroless composite plating proceeds, side products such as a phosphite formed through aging are accumulated in the solution as a result of the oxidative and reductive reactions. Moreover, although consumed components are supplemented, the solution composition in the plating solution always changes, and the electroless composite plating suffers a great influence of such a varying solution composition. This brings about the problem that the life of the bath inevitably becomes shortened.

Where an electroless composite plating solution is continuedly used with stably forming a good deposit, it is necessary to severely control the plating solutions and plating conditions. However, such a management requires very much labor and causes a lower production efficiency.

Accordingly, for the preparation of an electroless composite plating solution which is easy in handling and is capable of forming a plating film with a high commercial value having a uniform appearance, while taking the long life of the plating solution into account, it is not sufficient to use the surface active agents hitherto employed in this art and to appropriately control the concentrations thereof. Hence, there is a strong demand for further improvements and developments of electroless composite plating solutions.

SUMMARY OF THE INVENTION

It is therefore an object of the present invention to provide an electroless composite plating solution which can solve the related art problems.

It is another object of the present invention to provide an electroless composite plating solution which is capable of forming plating films having a smooth surface and good uniformity even after long-term use while keeping the plating properties such as a co-deposition ratio and a deposition rate, thus being very stable.

It is a further object of the present invention to provide an electroless composite plating method which makes use of such a plating solution and can be continuously and efficiently used for plating in wide fields of applications.

As a result of intensive studies for achieving the above objects, we have found that when using, in an electroless composite plating solution containing a hypophosphite as a reducing agent, a surface active agent comprising a quaternary ammonium salt surface active agent having two or more ethylene oxide groups and an alkyl group or a fluorine-substituted alkyl or alkenyl group which is cationic in nature or exhibits substantially cationic properties under pH conditions of the plating solution, the problems involved in the conventional electroless composite plating techniques can be solved. Moreover, it has also been found that such a solution ensures good plating properties such as a co-deposition ratio and a plating rate even after long-term use and enables to form a plating film having a smooth, non-roughened and uniform surface and a good appearance. In addition, when using such an electroless composite plating solution, electroless composite plating can be effected continuously in an efficient manner. The electroless composite plating solution and the method using the same according to the present invention can be optimally applied to very wide fields, for example, of various types of automotive sliding members, drive parts of precision instruments such as cameras and timepieces, molds, metallic masks in printing technologies, the whole range of household appliances such as irons, specific types of industrial blades and tools, and the like.

According to one embodiment of the present invention, there is provided an electroless composite plating solution comprising metal ions, a complexing agent for the metal ions, a hypophosphite serving as a reducing agent, a surface active agent, and a water-insoluble composite material wherein the surface active agent comprises a quaternary ammonium salt surface active agent which has two or more ethylene oxide groups and an alkyl or a fluorine-substituted alkyl or alkenyl group and which is cationic in nature or is substantially cationic under pH conditions of a plating solution.

According to the present invention, there can be obtained an electroless composite plating solution which is capable of forming plating films having a smooth surface and good uniformity and which is stable in plating properties such as a co-deposition ratio and deposition rate. The plating solution ensures easy and efficient plating in a wide range of applications.

According to another embodiment of the present invention, there is also provided an electroless composite plating method comprising the steps of; immersing an article to be plated in the electroless composite plating solution defined above, whereby a composite plating film, in which the composite material is dispersed in a metal matrix derived of the metal ions in the plating solution, is formed on the surfaces of the article.

DETAILED DESCRIPTION OF THE INVENTION

The electroless composite plating solution of the present invention comprises metal ions, a complexing agent for the metal ions, a hypophosphite serving as a reducing agent, a surface active agent, and a water-insoluble composite material.

In the plating solution of the present invention, the surface active agent should comprise a quaternary ammonium salt surface active agent which has two or more ethylene oxide groups and an alkyl group or a fluorine-substituted alkyl or alkenyl group, and is cationic in nature or exhibits cationic properties under pH conditions of the plating solution.

In the quaternary ammonium salt surface active agent of the present invention, the total in moles of added ethylene oxide groups should preferably be in the range of 2 to 20, more preferably from 5 to 15, from the standpoint of the co-deposition ratio of a composite material in the resultant composite plating film and also of film appearance. The alkyl group should preferably have 8 to 16 carbon atoms on average, more preferably, from 10 to 16, and should preferably be linear from the standpoint of the co-deposition ratio and film appearance.

The quaternary ammonium salt of the present invention should preferably include those compounds of the following general formulae (1) to (4):

(1)

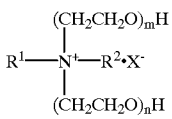

(2)

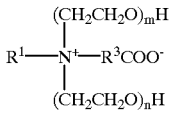

-continued (3)

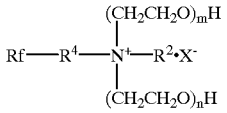

(4)

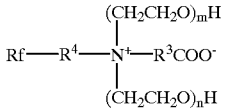

In the formulae, $R^1$ represents a group of $C_pH_{2p+1}$ or $C_pH_{2p+1}CO$, in which p is an integer of 8 to 16, $R^2$ represents an alkyl group having from 1 to 6 carbon atoms, an aryl group having from 6 to 10 carbon atoms or an aralkyl group having from 7 to 10 carbon atoms, X represents a halogen atom, $R^3$ represents an alkylene group having from 1 to 6 carbon atoms, Rf represents a fluorine-substituted alkyl or alkenyl group having from 6 to 10 carbon atoms, $R^4$ represents a divalent group joining Rf and nitrogen atom therewith, and m and n are each an integer provided that $m \geqq 1$, $n \geqq 1$ and $2 \leqq m+n \leqq 20$.

$R^1$ should preferably be an alkyl group having from 8 to 16 carbon atoms, more preferably from 10to 16 carbon atoms, or an acyl group of the formula; RCO—, wherein R represents an alkyl group having from 8 to 16 carbon atoms, more preferably from 10 to 16 carbon atoms. In this case, the alkyl group may be a mixed alkyl group, and includes, for example, a decyl group, a lauryl group, a myristyl group and a $C_{12}$ to $C_{16}$ mixed alkyl group (e.g., a mixed alkyl group derived from coconut).

$R^2$ includes, for example, a lower alkyl group such as methyl, ethyl, propyl and butyl, an aryl group such as phenyl, xylyl and tolyl, and an aralkyl group such as benzyl and phenylethyl. X includes, for example, Cl, Br and I.

$R^3$ should preferably be a lower alkylene group such as methylene, ethylene, propylene and butylene.

Rf is a fluorine-substituted alkyl or alkenyl group having from 6 to 10 carbon atoms, preferably including a linear perfluoroalkyl group represented by $C_pF_{2p+1}$ (wherein p=6 to 10) such as $C_6F_{13}$, $C_8F_{17}$ and $C_{10}F_{21}$. Examples of the fluorine-substituted alkenyl group include those of the following formulae:

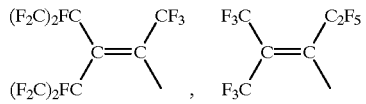

$R^4$ represents a divalent group capable of bonding the Rf group to nitrogen atom and includes, for example, an alkylene group having from 1 to 6 carbon atoms, which may have an NH group, an $SO_2$ group and an $SO_2NH$ group. Preferable examples include $—SO_2NH(CH_2)_q—$, wherein q is an integer of 1 to 6, preferably 3.

m and n are, respectively, such values that $m \geqq 1$, $n \geqq 1$ and $2 \leqq m+n \leqq 20$, preferably $5 \leqq m+n \leqq 15$.

More particularly, there can be used quaternary ammonium salts of the following formulae (1a) to (4a):

(1a)

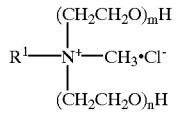

(2a)

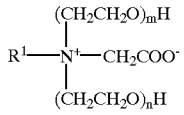

(3a)

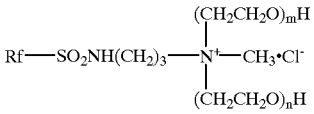

(4a)

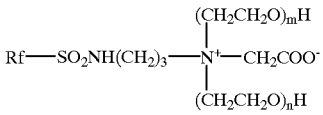

In the above formulae (1a) to (4a), $R^1$, Rf, m and n, respectively, have the same meanings as defined before. Preferably, $R^1$ represents a group mainly composed of $C_{12}H_{25}$, Rf represents $C_pF_{2p+1}$ (wherein p=6 to 10) such as $C_6F_{13}$ and $C_8F_{17}$ and m+n is in the range of 5 to 15.

The quaternary ammonium salts of the present invention may be used singly or in combination of two or more.

The amount of the quaternary ammonium salt to be added is in the range of 500 mg/liter or below, preferably 20 to 500 mg/liter, more preferably from 50 to 200 mg/liter, and most preferably from 50 to 150 mg/liter, in the plating solution. If the amount to be added is less than the above range, the effect of the quaternary ammonium salt cannot be presented satisfactorily. On the other hand, the use of the quaternary ammonium salt in excess undesirably tends to lower the co-deposition ratio of a composite material and film appearance after long-term use of the plating solution.

In the practice of the present invention, there may be further used, in addition to the quaternary ammonium salts, other types of surface active agents which are cationic in nature or substantially exhibit cationic properties under pH conditions of the plating solution. Such active agents are those which are known in the art of electroless composite plating as cationic surface active agents or surface active agents exhibiting substantially cationic properties under pH conditions of plating solutions. Examples include perfluoroalkyl quaternary ammonium salts, long-chain ($C_8$ to $C_{18}$) alkyltrimethyl-ammonium salts, dimethylalkyllauryl betaine and the like. It should be noted that the amount of these surface active agents to be added is in the range of 0 to 500 mg/liter, preferably from 1 to 300 mg/liter.

Moreover, nonionic surface active agents such as perfluoroalkylpolyoxyethylene ethanol and polyoxyethylene nonylphenyl ether may be added to the plating solution in amounts not impeding the effect of the present invention.

The electroless composite plating solution of the present invention further comprises as essential components metal ions, a complexing agent for the metal ions, a hypophosphite serving as a reducing agent, and a water-insoluble composite material.

Examples of the metal ions include nickel ions, cobalt ions, copper ions and the like. These metal ions are provided in the form of water-soluble metal salts, such as sulfates, chlorides and the like. The amount in the plating solution is in the range of 0.02 to 0.2 mole/liter, preferably from 0.05 to 0.1 mole/liter.

The complexing agents useful in the present invention may be one or more of carboxylic acids, oxycarboxylic acids and water-soluble salts thereof including, for example, citric acid, malic acid, EDTA, malonic acid, phthalic acid, maleic acid, glutaric acid, lactic acid, succinic acid, adipic acid, acetic acid and the like, and water-soluble salts thereof. Especially, chelating agents (e.g., citric acid, malic acid, EDTA, and water-soluble salts thereof) having intense metal complexing power, for example against nickel, are used in a total amount of 0.2 mole/liter or below, preferably from 0.02 to 0.2 mole/liter, and more preferably from 0.05 to 0.1 mole/liter. In addition, malonic acid, lactic acid, succinic acid and water-soluble salts thereof are effective components when used to improve a film appearance, pH buffering properties and throwing power. Accordingly, it is preferred to use these complexing agents in combination with the intense chelating agents in an amount of 2 moles/liter or below, preferably from 0.03 to 1.5 moles/liter, and more preferably from 0.05 to 1 mole/liter.

The total amount of the complexing agent is in the range of 0.05 to 2 moles/liter, preferably from 0.1 to 1.1 moles/liter.

The reducing agents used include hypophosphites such as sodium hypophosphite, and the amount of the reducing agent is not critical, but is generally in the range of 0.05 to 0.5 mole/liter, preferably from 0.15 to 0.3 mole/liter.

The water-insoluble composite materials used in the plating solution of the present invention may be appropriately selected depending on the use of a composite plating film and the type of plating solution. The materials preferably have self-lubricity, and examples of the materials include fluoroplastics such as TFE (tetrafluoroethylene) polymers or oligomers, tetrafluoroethylene-hexafluoropropylene copolymers (FEP) and tetrafluoroethylene-perfluoroalkyl vinyl ether copolymers (PFA), fluorinated graphite ($(CF)_x$), fluorinated pitch, graphite, molybdenum disulfide ($MoS_2$) and BN (boron nitride). These may be used singly or in combination.

The composite materials should preferably be in the form of particles, and their average particle size is in the range of 100 $\mu$m or below, preferably from 0.1 to 50 $\mu$m, and more preferably from 0.1 to 10 $\mu$m.

The amount of the composite material to be added to the plating solution is, in total, in the range of 100 g/liter or below, preferably from 0.1 to 100 g/liter, and more preferably from 0.1 to 20 g/liter.

The electroless composite plating solution of the present invention may further comprise stabilizers, reaction promoters, throwing power-improving additives and the like, which are ordinarily used in electroless plating solutions, if necessary.

Examples of the stabilizer include metal components such as Sn, Pb and the like, and compounds thereof. The reaction promoters include, for example, those additives capable of improving throwing power, such as thiourea and derivatives thereof.

The pH of the plating solution of the present invention should preferably be weakly acidic, and is in the range of pH 4 to 6, preferably pH 4.2 to 5.5 and more preferably pH 4.5 to 5.2. For the pH adjustment, acids such as sulfuric acid, hydrochloric acid and the like, and alkalis such as sodium hydroxide may be added to the solution.

In accordance with the electroless composite plating method of the present invention, the electroless composite plating solution described above is used, and articles to be plated are immersed in the plating solution. More particularly, an article to be plated is immersed in the composite plating solution wherein the composite material is uniformly dispersed, while if necessary, agitating the plating solution or rocking, at a temperature of 70 to 95° C., more preferably 80 to 90° C., thereby forming a composite plating film on the article surface wherein the composite material is co-deposited in a uniformly dispersed state.

In the above case, the agitation or rocking may be performed according to any known agitating or rocking methods. Because the electroless composite plating method of the present invention ensures a very good plating appearance and stable co-deposition ability under very intense rocking or agitating conditions, irradiation with ultrasonic waves, a specific type of liquid agitation such as agitation through super vibrations, or impact or rocking methods and conditions may be adopted for this purpose.

It should be noted that the articles to be deposited or plated are not critical with respect to the types thereof. Any materials including metals and plastics and ceramics whose surfaces are rendered electrically conductive may be used provided that electroless composite plating is enabled. The thickness of a composite plating film may be appropriately selected depending on the purpose and use of plated products, and is generally in the range of 1 to 30 $\mu$m. The deposition rate of a film is generally in the range of about 5 to about 20 $\mu$m/hour.

In the electroless composite plating solution, as plating proceeds, metal ions are reduced into metals by means of a reducing agent. As the composite material is allowed to co-deposit, the concentrations of the metal ions, reducing agent and composite material are lowered and the pH thereof is also lowered. Accordingly, it is preferred that a water-soluble metal salt, a reducing agent (a hypophosphite), a composite material and a pH adjuster (e.g., an alkali such as sodium hydroxide) are supplemented continuously or at appropriate timing, thereby returning the concentrations to originally preset levels, respectively. In this connection, the consumed amount of a nickel concentration, the consumed amount of a reducing agent, the consumed amount of a composite material, the lowered level of pH and the deposition amount of a composite plating film are mutually substantially in proportional relations. The deposition rate is kept substantially constant under the same plating conditions for the same initial concentrations in a plating solution. Accordingly, an initial concentration in the plating solution is kept constant and plating conditions are kept constant by supplementing given amounts of a water-soluble metal salt, a reducing agent, a composite material and a pH adjuster at given timing, thereby permitting the concentrations in the plating solution to be returned substantially to original ones. In some cases, the nickel concentration in or the pH of a plating solution is measured continuously or at given timing, and a water-soluble metal salt, a reducing agent, a composite material, and a pH adjuster may be supplemented based on the results of the measurements. Moreover, the concentrations in the solution may be controlled by analyzing the concentration of a composite material in the solution or the concentrations of other components.

The use of the plating solution of the present invention may be conveniently continued at least 4 turns or usually to 6 to 7 turns provided that such a supplement as mentioned above is continued.

It should be noted that the term "one turn" is intended to mean an index indicating a degree of aging of a plating solution at the point of time when a metal is deposited in an amount corresponding to an initial concentration of metal ions in a plating solution. More particularly, when an initial concentration of metal ions in a plating solution is 6 g/liter, the point of time when 6 g/liter of a metal is deposited from the solution is determined as one turn. Accordingly, the point of time when 24 g/liter of a metal is deposited is at 4 turns.

The electroless composite plating solution of the present invention ensures a plating film having a uniform surface and good uniformity even when used over a long term, and stable film properties with substantially a constant deposition rate and co-deposition ratio.

According to the present invention, there can be obtained a plating film which has a phosphorus content of 5 to 15% by weight, preferably from 7 to 12% by weight, and a content of a composite material of 40 volt or below, preferably from 1 to 30 volt, depending on the concentration of a hypophosphite and the amount of a dispersed composite material.

The electroless composite plating method using the plating solution of the present invention ensures efficient plating on a wide variety of articles to be plated. More particularly, the method can be widely applied to the fields of various types of automotive sliding members, drive parts of precision instruments such as cameras and timepieces, molds, metallic masks used in specific printing techniques, the whole range of household appliances such as irons, and specific types of industrial blades and tools.

EXAMPLE

The present invention is more particularly described by referring to examples, which should not be construed as limiting the invention thereto. Comparative examples are also described.

Examples 1, 2 and Comparative Examples 1 to 5

Electroless Ni—P/PTFE composite plating solutions having the following bath compositions (see Table 1 for surface active agents 1 and 2) were prepared, and used for electroless composite plating on a steel sheet and a stainless steel sheet. A continuous use test was conducted for comparing a film appearance, a co-deposition ratio, and a deposition rate with those at the time of initial plating (0 turn) to evaluate whether or not initial plating properties are kept. The results are shown in Table 2.

| <Solution composition> | |
|---|---|
| Nickel sulfate ($NiSO_4.7H_2O$) | 0.07 mole/liter |
| Sodium hypophosphite monohydrate | 0.22 mole/liter |
| Malic acid | 0.10 mole/liter |
| Malonic acid | 0.30 mole/liter |
| Adipic acid | 0.85 mole/liter |
| Stabilizer | very small amount |
| Thiourea | very small amount |
| Surface active agent 1 (fluorine-based cation, see Table 1) | 150 mg/liter |
| Surface active agent 2 (see Table 1) | 150 mg/liter |
| PTFE (MP1100, available from Du Pont, average primary particle size = 0.3 $\mu$m) | 3.0 g/liter |

<Plating Conditions> pH of solution=4.9
Bath Temperature: 90° C.
Stirring: gentle
Rocking: nil
Plating time: 30 minutes

TABLE 1

| | Surface active agent 1 | Surface active agent 2 |
|---|---|---|
| Example 1 | Cation: perfluoroalkyl quaternary ammonium iodide (Sumitomo 3M: FC-135) | Cation: ethylene oxide-added quaternary ammonium salt *1 ($R^1$ = coconut, average number of ethylene oxide units = 15) |
| Example 2 | Cation: perfluoroalkylpoly-oxyethylene quaternary ammonium chloride*2 (Rf = $C_8F_{17}$, average number of EO units = 5) | Nil |
| Comp. Ex. 1 | Cation: perfluoroalkyl quaternary ammonium iodide (Sumitomo 3M: FC-135) | Nil |
| Comp. Ex. 2 | Cation: fluoroalkyl ammonium iodide (Neos:. Phthagent FT-300) | Nonion: perfluoroalkyl-polyoxyethylene ethanol (Sumitomo 3M: FC-170C) |
| Comp. Ex. 3 | Cation: perfluoroalkyl quaternary ammonium iodide (Sumitomo 3M: FC-135) | Nonion: polyoxyethylene nonyl phenyl ether (Kao Corp.: Emargen 930) |
| Comp. Ex. 4 | Cation: perfluoroalkyl quaternary ammonium iodide (Sumitomo 3M: FC-135) | Cation: lauryltrimethyl-ammonium chloride (Kao Corp.: Kotamine 24P) |

TABLE 1-continued

| | Surface active agent 1 | Surface active agent 2 |
|---|---|---|
| Comp. Ex. 5 | Cation: perfluoroalkyl quaternary ammonium iodide (Sumitomo 3M: FC-135) | Amphoteric: dimethylakyl lauryl betaine (Nippon Oil and Fats Co., Ltd.: Nissan Anon BL) |

*1: In formula (1a), $R^1$ is a coconut-derived mixed alkyl group, and m + n = 15.
*2: In formula (3a), Rf is $C_8F_{17}$, and m + n = 5.

Co-Deposition Ratio and Deposition Rate

On comparison with those at the time of commencement for use of a plating solution, lowering rates of the co-deposition ratio and the deposition rate were evaluated according to the following standards.

○: less than 20%
Δ: less than 40%
×: 40% or over

Appearance

○: good
Δ: bad
×: very bad

TABLE 2

| | Appearance | | | | Co-deposition ratio | | | | Deposition rate | | | |
|---|---|---|---|---|---|---|---|---|---|---|---|---|
| | 1 turn | 2 turn | 3 turn | 4 turn | 1 turn | 2 turn | 3 turn | 4 turn | 1 turn | 2 turn | 3 turn | 4 turn |
| Example 1 | ○ | ○ | ○ | Δ | ○ | ○ | ○ | ○ | ○ | ○ | ○ | ○ |
| Example 2 | ○ | ○ | ○ | ○ | ○ | ○ | ○ | ○ | ○ | ○ | ○ | ○ |
| Comp. Ex. 1 | ○ | Δ | x | x | ○ | ○ | x | x | Δ | x | x | x |
| Comp. Ex. 2 | ○ | ○ | Δ | x | ○ | ○ | Δ | x | ○ | Δ | Δ | x |
| Comp. Ex. 3 | Δ | Δ | x | x | ○ | Δ | x | x | ○ | Δ | x | x |
| Comp. Ex. 4 | x | x | x | x | ○ | ○ | Δ | x | ○ | Δ | x | x |
| Comp. Ex. 5 | x | x | x | x | ○ | ○ | x | x | Δ | x | x | x |

From the results of Table 2, it was confirmed that in Comparative Examples 1 to 3, a good appearance and a tolerable co-deposition ratio and a tolerable deposition rate were limited only for one to two turns. In Comparative Examples 4 and 5, all of the appearance, co-deposition ratio and deposition rate were poorer, thus confirming the lowering rates of these properties being very poor upon continuous use of the solutions. In contrast, the solutions of Examples 1 and 2 were able to keep a good appearance all through 1 to 4 turns, and the lowering rates in the co-deposition ratio and deposition rate were only slight, thus proving the solutions being high in performance. It should be noted that the solutions of Examples 1 and 2 could keep good properties to an extent of 5 to 6 turns.

Example 3 and Comparative Example 6

Using the same plating solution composition and plating conditions as in Example 1, a hydrocarbon-based ethylene oxide addition-type cation surface active agent was employed as surface active agent 2 (i.e., a surface active agent of formula (1a)) wherein a chain length of an alkyl moiety ($R^1$) and the total moles of added ethylene oxide were changed to check their influences on the co-deposition ratio of PTFE and the film appearance. The results are shown in Table 3.

Quantity of Co-Deposited PTFE (Co-Deposition Ratio)

◎: more than 20 vol %
○: 15 to 20 vol %
Δ: 10 to 15 vol %
×: less than 10 vol %

Film Appearance

◎: grayish black/uniform
○: grayish black/relatively non-uniform
Δ: grayish black/non-uniform
×: nickel gloss color/non-uniform

TABLE 3

| | Quantity of Co-deposited PTFE Alkyl chain length*1 | | Film Appearance | | |
|---|---|---|---|---|---|
| EO*2 | $C_{12}$ Lauryl | $C_{12}$–$C_{16}$ coconut-derived mixed alkyl | $C_{12}$ Lauryl | $C_{12}$–$C_{16}$ coconut-derived mixed alkyl | |
| 0 (trimethyl) | ○ | ○ | Δ | Δ | Comp. Ex. 6 |
| 2 | ◎ | ◎ | ○ | ○ | Example 3 |
| 5 | ◎ | ◎ | ◎ | ○ | |
| 10 | ◎ | ◎ | ◎ | ◎ | |

TABLE 3-continued

| | Quantity of Co-deposited PTFE Alkyl chain length*1 | | Film Appearance | |
|---|---|---|---|---|
| EO*2 | $C_{12}$ Lauryl | $C_{12}$–$C_{16}$ coconut-derived mixed alkyl | $C_{12}$ Lauryl | $C_{12}$–$C_{16}$ coconut-derived mixed alkyl |
| 15 | ◎ | ◎ | ◎ | ◎ |
| 20 | ○ | ○ | ○ | ○ |

*1: The alkyl chain length indicates a measure on an average because the alkyl having been used has a molecular weight distribution ascribed to the use of a natural substance. It should be noted that the coconut-derived mixed alkyl has a distribution covering $C_{10}$ to $C_{18}$ and is mainly composed of $C_{12}$ to $C_{16}$.
*2: EO represents ethylene oxide and the figure indicates the total moles of added EO (i.e., m + n).

Example 4 and Comparative Example 7

Using the same plating solution composition and plating conditions as used in Example 1, the interrelation of a concentration of polyoxyethylene laurylmethylammonium chloride used as surface active agent 2 (i.e., a surface active agent of formula (1a)) in a plating solution, the total moles of added ethylene oxide (m+n), and the life of a plating solution (turn number) were checked. The results are shown in Tables 4 to 6.

Film Appearance
◎: Best
○: Good
Δ: Relatively bad
×: Bad
× ×: Very bad

TABLE 4

| | 0 Turn (initial bath) | | | | | | | | | | |
|---|---|---|---|---|---|---|---|---|---|---|---|
| | Quantity of Co-deposited PTFE (%)*3 | | | | | Film Appearance | | | | | |
| | Concentration*1 | | | | | | | | | | |
| EO*2 | 0 (reference) | 20 | 50 | 100 | 150 | 0 | 20 | 50 | 100 | 150 | |
| 0 | 100 | 43 | 62 | 25 | 12 | Δ | x | x | x x | x x | Comp. Ex. 7 |
| 2 | | 115 | 115 | 114 | 110 | | ○ | ◎ | ◎ | ◎ | Example 4 |
| 5 | | 111 | 111 | 110 | 109 | | ○ | ◎ | ◎ | ◎ | |
| 10 | | 111 | 107 | 106 | 105 | | ○ | ◎ | ◎ | ◎ | |
| 15 | | 109 | 102 | 102 | 101 | | ○ | ◎ | ◎ | ○ | |

*1: Concentration (mg/liter) of polyoxyethylene laurylmethylammonium chloride in the plating solution.

*2: EO represents ethylene oxide, and the figure indicates the total moles of added EO (m + n).

*3: The value of the quantity of co-deposited PTFE is the one which is determined in relation to a co-deposition ratio at the time of the preparation of an initial bath (0 turn) wherein no polyoxyethylene laurylmethylammonium chloride is added, i.e., a reference, which is taken as 100%.

TABLE 5

| | Two-turn solution | | | | | | | | | | |
|---|---|---|---|---|---|---|---|---|---|---|---|
| | Quantity of Co-deposited PTFE (%)*3 | | | | | Film Appearance | | | | | |
| | Concentration*1 | | | | | | | | | | |
| EO*2 | 0 | 20 | 50 | 100 | 150 | 0 | 20 | 50 | 100 | 150 | |
| 0 | 96 | 60 | 47 | 17 | 9 | Δ | x | x | x x | x x | Comp. Ex. 7 |
| 2 | | 113 | 112 | 113 | 101 | | ○ | ◎ | ◎ | ◎ | Example 4 |
| 5 | | 110 | 105 | 103 | 103 | | ○ | ◎ | ◎ | ◎ | |
| 10 | | 111 | 107 | 106 | 105 | | ○ | ◎ | ◎ | ◎ | |
| 15 | | 109 | 102 | 102 | 101 | | ○ | ◎ | ◎ | ○ | |

*1, *2 and *3, respectively, have the same meanings as above.

TABLE 6

| | Four-turn solution | | | | | | | | | | |
|---|---|---|---|---|---|---|---|---|---|---|---|
| | Quantity of Co-deposited PTFE (%)*3 | | | | | Film Appearanoe | | | | | |
| | Concentration*1 | | | | | | | | | | |
| EO*2 | 0 | 20 | 50 | 100 | 150 | 0 | 20 | 50 | 100 | 150 | |
| 0 | 18 | 14 | 15 | 13 | 11 | x x | x x | x x | x x | x x | Comp. Ex. 7 |
| 2 | | 23 | 105 | 91 | 71 | | x | Δ | ○ | Δ | Example 4 |
| 5 | | 25 | 80 | 99 | 92 | | x | Δ | ◎ | ○ | |
| 10 | | 33 | 73 | 97 | 85 | | x | ○ | ◎ | Δ | |
| 15 | | 35 | 78 | 95 | 80 | | x | ○ | ◎ | Δ | |

*1, *2 and *3, respectively, have the same meanings as above.

Example 5

A plating solution having the following bath composition was prepared, followed by electroless plating on a steel sheet and a stainless steel sheet to evaluate the state of the plating solution and the resultant films. The results are shown in Table 7.

| | |
|---|---|
| <Solution composition> | |
| Citric acid | 0.1 mole/liter |
| Adipic acid | 0.2 mole/liter |
| Nickel sulfate ($NiSO_4.7H_2O$) | 0.07 mole/liter |
| Sodium hypophosphite monohydrate | 0.22 mole/liter |
| Ammonium sulfate | 0.30 mole/liter |
| Stabilizer | very small amount |
| Thiourea | very small amount |
| PTFE and Surface active agent | |
| Ethylene oxide-added quaternary ammonium salt of formula (1a) ($R^1$ = coconut-derived mixed alkyl, EO (m + n) = 15) | 100 mg/liter |
| PTFE (MP1100, made by Du Pont) | 3 g/liter |
| Fluorocarbon-based cationic surface active agent (FC-135 made by Sumitomo 3M) | 150 mg/liter |
| Additive components for side product | |
| Phosphorous acid and sodium sulfate | not added (initial bath/ 0 turn bath) |

<Plating Conditions>
pH of solution=4.9
Bath temperature: 90° C.
Stirring: 400 r.p.m. (revolutions of a stirrer)
Rocking: 2 m/minute
Plating time: 30 minutes

TABLE 7

| Results of Evaluation | |
|---|---|
| PTFE in plating solution | Dispersed well |
| Quantity of co-deposited PTFE in film | 25.1 vol % |
| Deposition rate of film | 9.9 μm/hour |
| Film appearance | Good (grayish black/uniform) |

Example 6

A plating solution having the following bath composition was prepared, followed by electroless plating on a steel sheet and a stainless steel sheet to evaluate the state of the plating solution and a film appearance. The results are shown in Table 8.

| | |
|---|---|
| <Solution composition> | |
| Same as that used in Example 5. | |
| PTFE and surface active agent | |
| Same as that used in Example 5. | |
| Additive components for side product | |
| Phosphorous acid | 1 mole/liter (bath corresponding to four turns) |

-continued

| | |
|---|---|
| Sodium sulfate | 0.4 mole/liter (bath corresponding to four turns) |

<Plating Conditions> pH of solution=4.9
Bath temperature: 90° C.
Stirring: 400 r.p.m.
Rocking: 2 m/minute
Plating time: 30 minutes

TABLE 8

| Results of Evaluation | |
|---|---|
| PTFE in plating solution | Dispersed well |
| Quantity of co-deposited PTFE in film | 24.2 vol % |
| Deposition rate of film | 8.8 μm/hour |
| Film appearance | Good (grayish black/uniform) |

Example 7

A plating solution having the following bath composition was prepared, followed by electroless plating on a steel sheet and a stainless steel sheet to evaluate the state of the plating solution and a film appearance. The results are shown in Table 9.

| | |
|---|---|
| <Solution composition> | |
| Same as that used in Example 5. | |
| PTFE and surface active agent | |
| Same as that used in example 5. | |
| Additive components for side product | |
| Phosphorous acid | 1 mole/liter (bath corresponding to four turns) |
| Sodium sulfate | 0.4 mole/liter (bath corresponding to four turns) |

<Plating Conditions> pH of solution=4.9
Bath temperature: 85° C.
Stirring: 400 r.p.m.
Rocking: 2 m/minute
Plating time: 30 minutes

TABLE 9

| Results of Evaluation | |
|---|---|
| PTFE in plating solution | Dispersed well |
| Quantity of co-deposited PTFE in film | 25.1 vol % |
| Deposition rate of film | 6.1 μm/hour |
| Film appearance | Good (grayish black/uniform) |

Comparative Example 8

A plating solution having the following bath composition was prepared, followed by electroless plating on a steel sheet and a stainless steel sheet to evaluate the state of the plating solution and a film appearance. The results are shown in Table 10.

| | |
|---|---|
| <Solution composition> | |
| Same as that used in Example 5. | |
| PTFE and surface active agent | |
| Ethylene oxide-added quaternary ammonium salt | not added |
| PTFE (MP1100, made by Du Pont) | 3 g/liter |
| Fluorocarbon-based cationic surface active agent (FC-135, made by Sumitomo 3M) | 150 mg/liter |
| Additive components for side product | |
| Phosphorous acid | 1 mole/liter (bath corresponding to four turns) |
| Sodium sulfate | 0.4 mole/liter (bath corresponding to four turns) |

<Plating Conditions> pH of solution=4.9
Bath temperature: 90° C.
Stirring: 400 r.p.m.
Rocking: 2 m/minute
Plating time: 30 minutes

TABLE 10

| Results of Evaluation | |
|---|---|
| PTFE in plating solution | Dispersed well |
| Quantity of co-deposited PTFE in film | 1.7 vol % |
| Deposition rate of film | 9.9 μm/hour |
| Film appearance | Bad (Nickel gloss color) |

What is claimed is:

1. An electroless composite plating solution comprising metal ions, a complexing agent for said metal ions, a hypophosphite serving as a reducing agent, a surface active agent, and a water-insoluble composite material, said surface active agent comprising a quaternary ammonium salt surface active agent which has two or more ethylene oxide groups and an alkyl group or a fluorine-substituted alkyl or alkenyl group, said quaternary ammonium salt surface active agent being cationic in nature or exhibiting substantially cationic properties under pH conditions of said plating solution.

2. An electroless composite plating solution according to claim 1, wherein said quaternary ammonium salt surface active agent has the molar number of ethylene oxide groups added of from 2 to 20 in total.

3. An electroless composite plating solution according to claim 1, wherein said quaternary ammonium salt surface active agent has a linear alkyl group having 8 to 16 carbon atoms on average.

4. An electroless composite plating solution according to claim 1, wherein said quaternary ammonium salt surface active agent is one selected from the group consisting of compounds of the following general formulae (1) to (4):

(1)

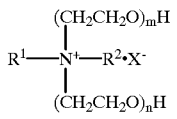

-continued (2)

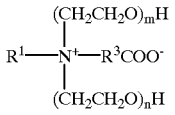

(3)

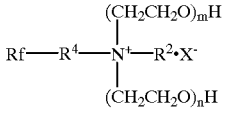

(4)

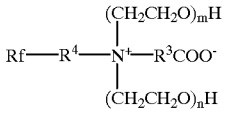

wherein $R^1$ represents $C_pH_{2p+1}$ or $C_pH_{2p+1}CO$ in which p is an integer of 8 to 16, $R^2$ represents an alkyl group having from 1 to 6 carbon atoms, an aryl group having from 6 to 10 carbon atoms or an aralkyl group having from 7 to 10 carbon atoms, X represents a halogen atom, $R^3$ represents an alkylene group having from 1 to 6 carbon atoms, Rf represents a fluorine-substituted alkyl or alkenyl group having from 6 to 10 carbon atoms, $R^4$ represents a divalent group joining Rf and nitrogen atom therewith, and m and n are each an integer provided that $m \geqq 1$, $n \geqq 1$ and $2 \leqq m+n \leqq 20$.

5. An electroless composite plating solution according to claim 1, further comprising a second surface active agent other than the quaternary ammonium salt surface active agent, said second surface active agent being cationic in nature or exhibiting substantially cationic properties under pH conditions of said plating solution.

6. An electroless composite plating solution according to claim 1, wherein said composite material is one selected from the group consisting of fluoroplastics, fluorinated graphite, fluorinated pitch, graphite, molybdenum disulfide and boron nitride.

7. An electroless composite plating solution according to claim 1, wherein said metal ions are nickel ions.

8. An electroless composite plating method comprising the steps of: providing an electroless composite plating solution defined in any one of claims 1 to 7, and immersing an article to be plated in said plating solution, thereby forming a composite plating film on said article wherein the composite material is dispersed in a metal matrix based on said metal ions.

* * * * *